United States Patent [19]

Kaufman

[11] Patent Number: 4,645,097

[45] Date of Patent: Feb. 24, 1987

[54] SIDEWALL DISPENSER

[76] Inventor: John G. Kaufman, 858 Condor Drive, Burlington, Ontario L7T 3A7, Canada

[21] Appl. No.: 753,229

[22] Filed: Jul. 9, 1985

Related U.S. Application Data

[63] Continuation-in-part of Ser. No. 482,776, Apr. 7, 1983, abandoned.

[51] Int. Cl.[4] ..... B65D 37/00

[52] U.S. Cl. ..... 222/207; 222/211; 222/212; 222/534

[58] Field of Search ..... 222/129, 206, 207, 209, 222/211, 215, 464, 547, 564, 571, 372, 383, 531, 533–534, 556

[56] References Cited

U.S. PATENT DOCUMENTS

| | | | |
|---|---|---|---|
| 762,299 | 6/1904 | Fulton | 222/206 |
| 3,178,081 | 4/1965 | Adams | 222/464 X |
| 4,282,991 | 8/1981 | Hazard | 222/531 |
| 4,324,349 | 4/1982 | Kaufman | 222/207 |
| 4,330,072 | 5/1982 | Mastman | 222/209 |
| 4,420,098 | 12/1983 | Bennett | 222/190 |
| 4,516,697 | 5/1985 | Preps et al. | 222/212 |

*Primary Examiner*—Joseph J. Rolla
*Assistant Examiner*—Michael S. Huppert
*Attorney, Agent, or Firm*—Rogers & Scott

[57] ABSTRACT

A liquid dispenser is described which dispenses liquid through a sidewall of the dispenser. The dispenser includes an air pocket structure in a lower portion adjacent the container base and a dispensing exit at the same level as the air pocket structure. The dispenser can be squeezed to reduce the volume in the container and cause liquid to be ejected from the dispensing exit. The exit and air pocket structure are proportioned so that on release of pressure, air is sucked-back into the dispenser through the exit and air pocket to remove liquid in the exit and eliminate dripping. The air pocket is also designed to compensate for temperature increases of 30° F. to 40° F. without having product leakage. The dispenser can accommodate liquids of different viscosities and various preferred embodiments are disclosed for different dispenser applications.

19 Claims, 14 Drawing Figures

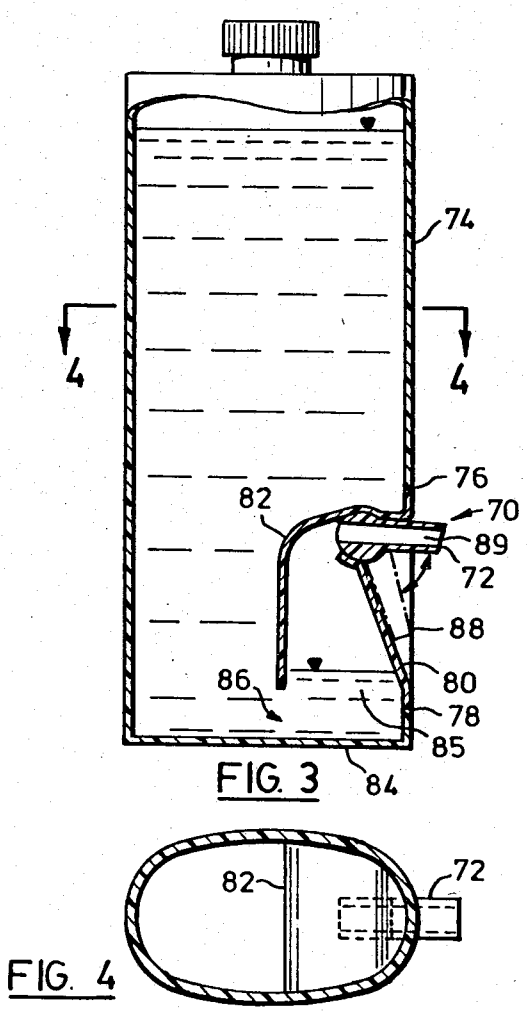
FIG. 3
FIG. 4
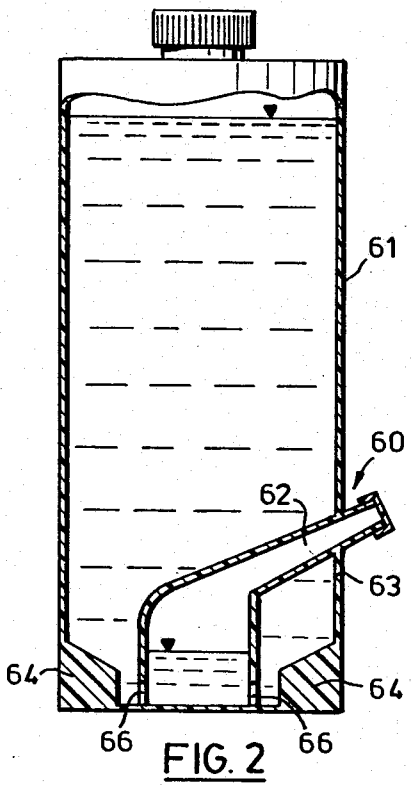
FIG. 2
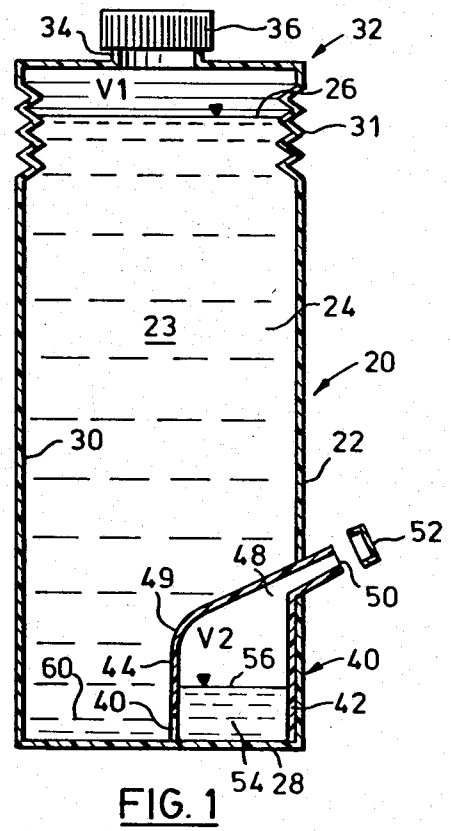
FIG. 1

107
105
104
114
109
9
107
110
9
100
102
105
104
108
112
106
110

106

90
92
96
97
16
93
95
94
93

6

SIDEWALL DISPENSER

This application is a continuation-in-part of U.S. patent application Ser. No. 482,776 filed Apr. 7, 1983, now abandoned.

The present invention relates to a dispenser for dispensing liquid products and particularly, but not exclusively, to squeeze type dispensers having means when squeezed for dispensing a liquid product through a sidewall of the container.

There are many types of containers on the market for dispensing liquid products, and some of these are recited in detail below. To be commercially acceptable such dispensers should satisfy a number of basic criteria in addition to being suitable for inexpensive manufacture using conventional mass production machinery. For instance, in the case of sidewall dispensers, the user should be able to see liquid being poured or squeezed from the container to provide visual feedback so that carefully controlled amounts of liquid can be dispensed, for example from one drop to half a cup. Also liquid dispensers should preferably dispense without dripping, accept a wide range of viscosities, and provide temperature compensation so that when the container is almost empty, any significant temperature increase will not cause liquid to drip from the outlet.

Various types of liquid dispensers have been proposed in the art. For example, U.S. Pat. No. 762,299 to Fulton which issued in 1904 relates to a receptable for liquids which is provided with means for forcing out or ejecting liquid when it is desired to withdraw it from the receptacle. FIG. 1 of Fulton shows an exit tube 2 exiting from the bottom of a sidewall, however this tube rises up in a swan neck arrangement and the dispensing exit is substantially at the top of the dispenser. There is no air pocket structure within the dispenser and there is no suck-back control means for sucking back viscous products from the dispensing exit to avoid dripping. Also, the dispensing exit slopes downward from the high portion above the level of the container and this makes it very difficult to suck-back residue efficiently particularly when the residue is viscous.

FIG. 2 of Fulton shows a similar structure, however the tube 2 does not pass through a sidewall but passes through a top wall instead and is located near to the bottom of the dispenser. This is not a sidewall dispenser and also, in this embodiment, there is no effective suck-back because there is no suck-back control means in the form of an air pocket structure with the container. The embodiments in the Fulton patent do not completely empty, rendering such structures commercially unacceptable for large volume production.

U.S. Pat. No. 3,178,081 to Adams issued in 1965 and relates to a metering liquid dispensing device. This patent does not show any dispensers with an outlet means passing through a sidewall of the container. This patent is concerned with a metering liquid dispensing device which has to inverted through 180° as shown in FIG. 2 in order to dispense metered amounts of liquid. This is commercially disadvantageous because it has been found by consumer surveys that this is not desirable and it is very much desired to be able to dispense a metered amount of liquid without inverting the container. FIG. 3 of this patent illustrates that the container can be used as a continuous dose container by positioning it on its side. However, the container is simply concerned with pouring and there is no air pocket structure to provide suck-back control means or outlet control means for sucking-back liquid residue in the outlet. This again is merely compensated for by sitting the container upright. It is also noteworthy that the Adams container cannot be used in an upright position to dispense liquid, although the patent does disclose that the body portion of tubing 22 can extend through an upper portion of the sidewall. This does not result in an effective or commercial sidewall dispenser because there is no suck-back control means or outlet control means so that this type of dispenser is totally unsuitable for use with viscous products. In addition, because the outlet is in an upper portion of the container 10, it is extremely difficult to dispense any liquid from the dispenser in an upright position. This is the reason why the container has to be tilted through 180° or turned on its side as shown in FIGS. 2 and 3.

Another disadvantage of the Adams structure is that the lack of suck-back control limits the use of the container to liquids in a selected viscosity range. This is due to the fact that the bore of the tube is constant and there is no outlet control means for controlling liquid suck-back.

It is an object of the present invention to provide a dispenser which obviates or mitigates disadvantages associated with prior art structures.

This is achieved by providing an air pocket structure within a container in a lower portion thereof and having an outlet from the air pocket structure through a sidewall of the container also at a lower portion thereof. The structure provides suck-back control means between the outlet and the air pocket structure so that following dispensing of liquid, residue in the outlet is forced back into the container and dripping is eliminated. Also the air pocket structure is proportioned so that significant increases in ambient temperature do not result in dripping.

The invention will be better understood with reference to the following description when taken in combination with the accompanying drawings in which:

FIG. 1 is a diagrammatic sectional view of a liquid filled sidewall dispenser according to a first embodiment of the invention;

FIG. 2 is a view similar to FIG. 1 of a liquid filled sidewall dispenser according to a second embodiment of the invention;

FIG. 3 is a view similar to FIG. 1 of a third embodiment of the invention, this sidewall dispenser having an alternative air pocket structure and dispensing exit;

FIG. 4 is a sectional top view on line 4—4 of FIG. 3;

Figures 5, 6, 7, 8, 9:
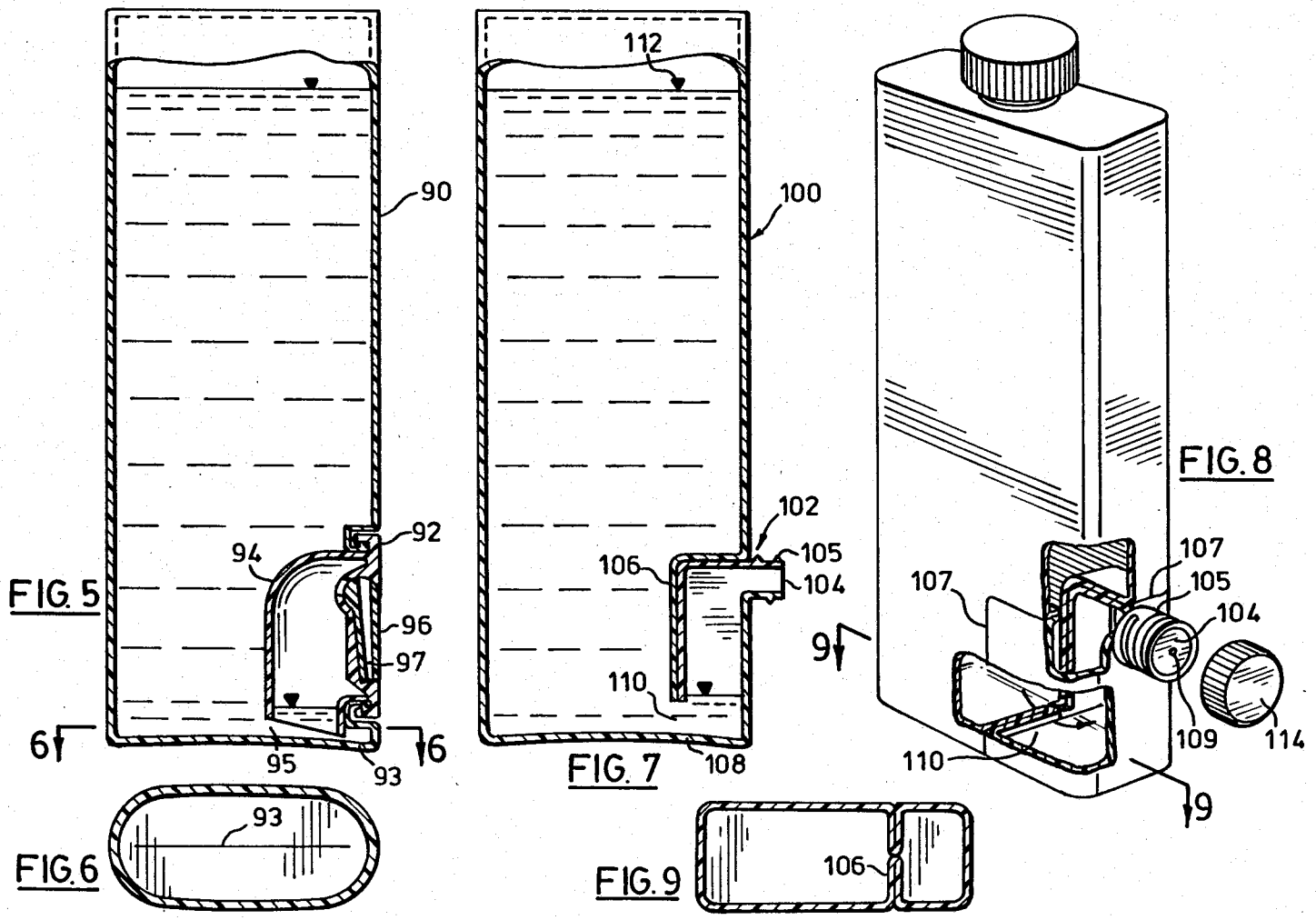
FIG. 5 is a sectional view of a fourth embodiment which is a disposable sidewall dispenser with a snap-in air pocket structure.
FIG. 6 is a sectional top view a line 6—6 of FIG. 5.
FIG. 7 is a view similar to FIG. 1 of a fifth embodiment of the invention and showing a disposable sidewall dispenser in which the entire air pocket structure is integral with the dispenser.
FIG. 8 is perspective and partly broken away view of the dispenser shown in to FIG. 7.
FIG. 9 is a sectional top view on line 9—9 of FIG. 8.

Reference is made firstly to FIG. 1 of the drawings which shows a liquid dispenser generally indicated by reference numeral 20 which has a container body 22, and in the interior 23 of which is a liquid 24 such as liquid syrup, shaving cream, detergent, ketchup and the like. The liquid extends downwardly from a level 26.

The container body 22 is generally oval, or rectangular in cross-section with rounded corners, and comprises a base 28, a sidewall 30 and a container top 32. The container top 32 has a neck 34 for receiving a cap 36 and, of course, removal of the cap permits the container to be filled through the neck. The sidewall 30 has integral bellows 31, generally indicated by reference numeral 38, located in proximity to the container top 32 for permitting the container to be squeezed to increase pressure within the container for dispensing liquid as will be described in detail later.

A partial vacuum is defined in the volume V1 between the liquid level 26 and the top 32 and this volume increases as the liquid is dispensed. At the bottom of the container body 22 there is located an air pocket structure generally indicated by reference numeral 40 which is in proximity to a sidewall and to the base 28 of the container on which the container normally stands. The air pocket structure shown has a volume of about one and a half liquid ounces (for a 12 oz. container) and has a front wall 42 and back wall 44 which extends into the container and substantially across the width of the container between the sidewalls. The front wall 42 extends to the base of the container 28 and the rear wall terminates a predetermined distance above the base to define a liquid passageway extending across the width of the container, generally indicated by reference numeral 46, for permitting liquid communication between the interior 23 of the dispenser and the interior of the air pocket structure 40.

At the top of the air pocket structure there is provided a funnelling outlet means generally indicated by reference numeral 48 which passes through the sidewall 30 of the container to terminate at a dispensing exit 50 which is slightly above the level at which the outlet passes through the sidewall. The air pocket structure and outlet means 48 may be generally referred to as outlet control means.

The back wall 44 blends smoothly into the outlet means 48 at curved portion 49 to eliminate any air pocket during dispensing which could disrupt continuous flow of liquid, ie. cause gurgling.

The dispensing exit shown is about one quarter the way up the container sidewall and is generally circular and proportioned to receive a closure in the form of a cap 52 which can be fitted over the dispensing exit to prevent leakage of liquid when transporting the dispenser as will be described.

It will be appreciated that the liquid passageway 46 may be provided by a single opening or by a plurality of slots. In this embodiment the air pocket structure is first injection moulded and then the dispenser is formed around the air pocket structure to provide the structure shown. In this regard the proximity of the air pocket structure to the sidewall facilitates complete emptying of the container as will be later described. In the diagram shown the body of the container 20 is sealed apart from the outlet conduit 48.

In the diagram shown liquid is present in the container and the pressure in the space above the liquid is less than atmosphere. This together with the viscosity of the particular liquid and the external atmospheric pressure sets the level 56 of an auxiliary body of liquid indicated generally by reference numeral 54 and located in the air pocket structure 40. Above the level 56 is a pocket of air V2 at atmospheric pressure. It will be appreciated that temperature fluctuations will change the partial vacuum, the external atmospheric pressure and the viscosity of the liquid resulting in changes of the level 56. Should the ambient temperature increase by, for example, 40° F. then of course the air pressure in volume V1 would increase to force the level 56 to rise inside the air pocket structure However the volume of the air pocket structure is designed so that for normal temperature fluctuations this level will never rise above the level of the dispensing exit 50. Thus this structure is readily designed to provide temperature compensation for a wide range of liquids with different viscosities.

The cap 52 is not necessary to prevent inadvertent dripping of liquid under normal operation as the temperature in the atmosphere changes but is provided to be closed for transportation.

In order to dispense liquid from the container through the dispensing exit 50, a force is applied to the top of the dispenser 20 which typically involves placing a hand on top of the container and pressing down on the container such that the bellows collapses to increase the pressure in the volume V1 of liquid level 26. Of course there is no need to lift the dispenser. When the pressure in the volume V1 is increased, the liquid level of the auxiliary body of liquid 56 rises within the air pocket structure and forces the air in the air pocket portion out of the air pocket structure through the outlet means 48 and dispensing exit 50. Once the air pocket structure and outlet means are filled, liquid will then begin to discharge through the dispensing exit 50. The smooth curved portion 49 prevents gurgling caused by air accumulation and the dispensing is controlled by the amount of depression of the bellows.

When the force on the container is relieved, the pressure in the volume above the level 26 is reduced and consequently air is sucked in through the dispensing exit 50 and the liquid, flows back into the air pocket structure and through the liquid passageway 46 back into the interior of the container 20. This suck back will continue until equilibrium is reached and may include flow of air into the interior 23 and through the liquid 24. In the case of particularly viscous liquids, the slope of the outlet conduit, which is downwardly towards the interior of the container, assists in returning the residue in the outlet into the air pocket structure.

It will be appreciated that the cross-section of the air pocket structure 40 decreases towards the outlet. This results in providing a suck-back control means because the energy of the air returning through the outlet clears the liquid from the outlet means. The air then loses some velocity before assisting gravity to return the residue from the outlet to the auxiliary body of liquid.

The design of the air pocket structure is therefore important to provide efficient suck-back over a wide range of viscosities so that dripping from the outlet is prevented.

It should be noted that the liquid passageway 46 extends across the width of the container so that when there is a small volume of liquid remaining in the dispenser (for example when the level of liquid is indicated by broken line 60) the dispenser can be tipped so that the liquid rolls through the liquid passageway 46 and into the air pocket structure 40. Consequently, by tilting and simultaneously squeezing the bellows, the last portion of liquid can be dispensed through exit 50. This ensures that the user can dispense essentially all of the product from the dispenser. When it is desired to refill the container, the exit 50 is closed using cap 52, and after removing cap 36 more liquid is poured through neck 34 to selected level and then the cap 36 is replaced.

In the FIG. 1 embodiment the level of the dispensing exit is preferably about one quarter the height of the sidewall of the dispenser. This gives the desired dispensing characteristics without undue delay between initiating a squeeze on the dispenser and discharging the product from the exit 50.

It will be appreciated that various modifications may be made to this embodiment without departing from the scope of the invention. For example instead of using the bellows 31, the walls could be resilient so that the user simply squeezes the dispenser walls to pressurize the dispenser. The cap 52 could be threaded on to the exterior of the outlet means and multiple liquid passageways could be provided between the air pocket structure and the interior of the liquid container. Also a neck insert with small exit holes could be inserted in the outlet means 48 for permitting spraying of low viscosity liquids.

An alternative embodiment is shown in FIG. 2 which is somewhat similar to that shown in FIG. 1. In this embodiment the sidewall of the dispenser does not include bellows but instead is made of a sufficiently resilient material to permit the container to be squeezed. The dimensions and proportions of an air pocket structure 60 and container body 61 are substantially the same as that shown in FIG. 1 except that the air pocket structure is located at the centre of the container and has an outlet conduit 62 passing through the sidewall 63. The walls at the base of the container body have shoulder portions 64 which effectively narrow the interior of the container to direct liquid near to the base of the air pocket structure to facilitate emptying of the dispenser without tilting the dispenser. In this regard it will be appreciated that there are at least two liquid passageway openings 66 shown located between the base of the container and the air pocket structure to facilitate passage of liquid between the air pocket structure and the interior of the container for dispensing. Manufacture of this dispenser would be similar to the dispenser shown in FIG. 1. For example the air pocket structure would be injection moulded and then the liquid container formed around the air pocket structure. Similarly a cap can be provided on the dispensing exit to permit transport of the dispenser. It will be appreciated that the dispensing of liquid using the structure of FIG. 2 is substantially similar to that shown in FIG. 1 with temperature compensation and suck-back being achieved by the same structural components and relationships. In this regard it will be appreciated that the dispensing exit 50 is also about one quarter the height of the container to facilitate ease of dispensing.

A third embodiment shown in FIGS. 3 and 4 is also somewhat similar to that shown in FIG. 1. In this case the air pocket structure, generally indicated by reference numeral 70, is injection moulded and has a flip top, generally indicated by reference numeral 72 snap-fitted into the air pocket structure as shown. The container body 74 is then formed around the air pocket structure and joined at a continuous seam including portions 76 and 78 in the diagram. It will be seen that the air pocket structure has a front wall portion 80 which forms part of the front wall of the container 74 and a rear wall portion 82 which forms part of the air pocket structure. As in FIGS. 1 and 2, the rear wall portion is curved at its top to facilitate smooth continuous dispensing of liquid. The rearwall portion 82 terminates a distance above a base 84 of the container body 74 to define a liquid passageway 86 by which liquid from the interior of the container communicates with an auxiliary body of liquid 85 within the air pocket structure. It will be seen in FIG. 4 that the rear wall portion 82 extends across the width of the container to facilitate, as already described with reference to FIG. 1, complete emptying of the container when the level of liquid is very low. This is done by tilting the dispenser so that liquid on the bottom of the container rolls into the air pocket structure. The resilient walls of the container are then squeezed to force the liquid to be dispensed through the outlet provided by the flip top 72.

It will be appreciated that the flip top is moveable between the position for dispensing, as shown in FIG. 3, and a non-dispensing position indicated by reference numeral 88 (and shown in ghost outline). In this position the outlet conduit provided by the interior of the flip top is sealed and this is very convenient for transporting the dispenser. It will also be seen that the flip top 72 has an interior conduit indicated by reference numeral 89 which is short and relatively wide to so as to provide minimum back pressure and permit even very viscous liquids to be dispensed. In addition the air pocket structure is designed so that temperature compensation can be provided when the container is almost empty and the ambient temperature changes by 30° to 40° F. so that there will be no dripping of liquid through the outlet in the absence of pressure being applied to the container.

Modifications may be made to the embodiment shown in FIGS. 3 and 4 without departing from the scope of the invention. For example, although the shape of the bottle is oval in plan it will be appreciated that this could readily be rectangular with curved corners. These shapes have been found to most readily permit squeezing of the bottl to dispense liquid and also to facilitate complete emptying of the bottle by providing a passageway which extends between opposite sidewalls.

In this embodiment it will be seen that the height of the flip top is no more than one third of the height of the sidewall of the dispenser to facilitate ease of dispensing and minimise resistance to dispensing and to facilitate controlled liquid suck-back.

A fourth embodiment of the invention is shown in FIG. 5 which has a dispenser generally indicated by reference numeral 90 into which is snap fitted an air pocket structure, indicated by reference numeral 92, the air pocket structure having a volume of about 1 to 1½ oz, for a 12 oz container. It will seen that the container 90 does not have a cap and this structure is made by having the air pocket structure 92 injection moulded and a flip top snap-fitted therein as shown. Then the container 90 is blow moulded with an opening and then the air pocket structure snap-fitted into the container body. The container is filled by inverting it 180°, and the liquid is then inserted through the bottom 93 of the container which is curved towards the interior of the container using conventional high-speed filling techniques and then, once the predetermined volume of liquid has been inserted the entry is heat sealed to leave a seal line 95, as shown in FIG. 6 to leave a line on the bottom of the container and the container then inverted to the position shown. This type of container is designed to be disposable and here again it will be appreciated that if necessary, a filling cap could be provided similar to those in FIGS. 1–3.

The operation of this dispenser is substantially the same as that of FIG. 4 with a smoothly curving back wall 94 of the air pocket structure extending substantially across the width of the container which is of oval shape to facilitate emptying of the liquid when a very small amount of liquid is present in the container, and continuous smooth dispensing. The air pocket structure has a flip-top 96 which is proportioned to provide minimum back pressure and to facilitate emptying of the dispenser and the bore 97 of the flip top is small compared to the interior size of the air pocket structure which provides suck back as herebefore described. It will be appreciated that in this embodiment the walls of the container 90 are resilient to permit the presure above the liquid to be increased and thus dispense liquid. In all other aspects of the operation it is the same as the previously described containers. However, in this case the snap-fit can be ultrasonically welded.

Reference is now made to FIGS. 7 to 9 of the drawings which illustrate a fifth embodiment of a dispenser in accordance with the present invention. A container 100 is blow moulded and pinched during the manufacturing process to create an integral air pocket chamber 102 within the container to provide an outlet 104 which communicates between the air pocket structure and the exterior of the container. The outlet 104 has external threads 105 for receiving a cap to provide a closure for the dispenser which is filled in the same way as described with reference to FIG. 5 and is of generally rectangular cross-section except that it has rounded corners. This is best illustrated in FIGS. 8 and 9. In FIG. 8 which is partly broken away it shows how the container is pinched during manufacturing, at lines 107 to force the sidewalls to deform to meet each other and define the air pocket structure, as best seen in FIG. 9 which is about ⅓ of the way across the length of the container. Similarly just above the outlet of the container, it is also pinched at lines 107 to create the air pocket structure 102 as best seen in cross-section in FIG. 7. The pinched portion creates a back wall 106 spaced above the bottom 108 of the container to define a liquid passageway 110 through which liquid in the interior of the container body and the air pocket structure communicates.

It will be seen that the liquid passageway means shown in FIG. 8 is sufficiently large to permit easy passage of even viscous liquids to form the auxiliary body of liquid and to permit rapid and easy dispensing of liquid in a dispensing mode. In this regard it will be seen that the outlet 104 has a smaller orifice 109 which is relatively wide and short to provide controlled dispensing of very low viscosity products, such as water and vinegar, with adequate suck-back. Of course the cap 114 is threaded on to the exterior of the outlet 104 to permit the dispenser to be transported.

It will be appreciated that the operation of the dispenser shown in FIGS. 7 and 8 is substantially the same as that for FIG. 5 and filling of the dispenser occurs in the same way. It will be understood that various modifications may be made to this embodiment without departing from the scope of the invention. It will be appreciated that the dispenser may have a cap located at the top in a similar manner to that shown in FIGS. 1 to 3 for permitting filling of the bottle so that the dispenser is reusable. Also, the air pocket size can be varied during manufacture to suit particular liquid viscosities and dispensing requirements and the outlet could be shaped so as to receive a flip top type nozzle instead of the threaded integral outlet cap. The orifice 109 can be made the size of the outlet bore to facilitate dispensing of viscous liquid products.

Figures 10, 11, 12, 13, 14:
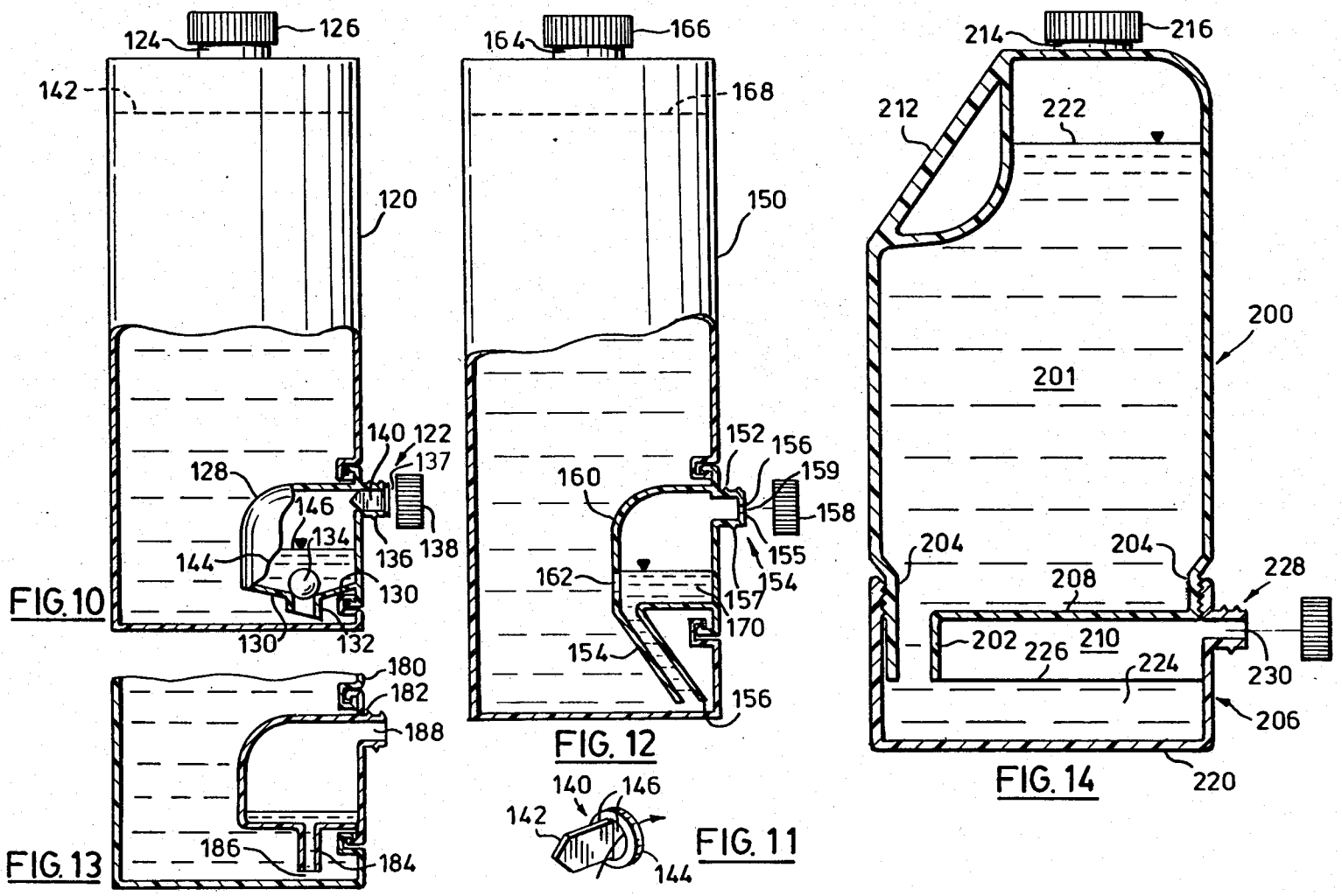
FIG. 10 is a sectional view of a sixth embodiment and having a snap-in air pocket structure for dispensing a unit dose of liquid.
FIG. 11 is an enlarged perspective view of an insert used in the embodiment.
FIG. 12 is a view similar to FIG. 1 of a seventh embodiment and having a snap-in air pocket structure providing a predetermined temperature compensation.
FIG. 13 is a view similar to FIG. 1 of an eighth embodiment and also having a snap-in air pocket structure for permitting controlled dispensing of very low viscosity liquids.
FIG. 14 is a sectional view of a ninth embodiment of a sidewall dispenser for dispensing larger volumes of liquid.

Reference is now made to FIG. 10 of the drawings which shows a dispenser designed to dispense unit doses of liquid. In this regard there is provided a transparent plastic container 120 which has an air pocket structure, generally indicated by reference numeral 122, snap-fitted therein. Container 120 has a neck 124 to which can be screwed a cap 126 for filling the dispenser. The air pocket structure 122 is injection moulded from a clear see-through plastic and a graduated scale 128 is marked on the back wall thereof. The air pocket structure appears generally square in this view and it will be appreciated that this air pocket structure again extends substantially across the width of the container 120. The bottom walls 130 taper downwardly to define a liquid passageway conduit 132. The conduit terminates in an oblique opening which tapers down towards the base of the container, near to the front of the container, to facilitate nearly complete emptying of the liquid. The air pocket structure has a non-floating ball 134 located therein, having been inserted through outlet 140 and, which is freely moveable and which in the non-dispensing position shown, sits over the conduit 132 as shown. The air pocket structure has an outlet 136 which is threaded to receive a cap 138 to facilitate the transport of the dispenser. The outlet conduit has an insert 140, best seen in FIG. 11, inserted therein. The insert 140 has a tongue 142 and an integral ring 144 which defines apertures 146 between the tongue and the ring to permit outflow of liquid from the dispenser as will be later described. The tongue projects into the interior of the air pocket structure slightly to prevent the ball 134 from blocking the outlet conduit 136 when in a dispensing mode. It will be seen in this drawing that the outlet 136 has a dispensing exit 137 which is at a level no more than a quarter of the height of the dispensing container 120.

The walls of container 120 are resilient and the liquid level 142 above which there is a partial vacuum when the cap 126 is on the container. The air pocket structure has an auxiliary body of liquid, generally indicated by reference numeral 144, which has a liquid level 146 above which is air in the air pocket structure at atmospheric pressure. In order to dispense liquid in a unit dose, the container is squeezed until liquid forces the ball 134 away from the outlet conduit 132 and liquid rises to a level to be dispensed as indicated on the graduated scale 128. When pressure is released suck-back causes the ball to sink and be retained over conduit 132. The dispenser is then tipped through about 135 degrees until the amount of liquid in the air pocket structure passes through the outlet conduit 136. The container is squeezed to release the ball for subsequent filling and the tongue 142 prevents the ball 134 from blocking the conduit during dispensing.

When the bottle is tipped the fluid in the dispensing container 120 does not run into the air pocket structure thus altering the dosage. When the dose is dispensed the container is simply set upright again and when further liquid is required to be dispensed, the same procedure is repeated.

It will be appreciated that various modifications may be made to the embodiment described in FIGS. 10 and 11 without departing from the scope of the invention. For example, it will be appreciated that other outlet means and insert means could be provided to prevent blockage of the cap and a flip top could also be provided for an outlet in a similar manner to that shown in FIG. 5. The container may also be made without a cap 124 and filled as described with references to FIGS. 5 to 8. Also the conduit 132 need not extend across the width of the container.

Reference is now made to FIG. 12 of the drawings which is a sidewall unit dose dispenser having a predetermined amount of temperature compensation and designed to fully empty the container. The container, generally indicated by reference numeral 150, has an air pocket structure, generally indicated by reference numeral 152, which is snap-fitted therein. The air pocket structure is made by injection moulding as previously described and the bottle has been blow moulded to the shape for receiving the cap snap-fitting arrangement. This air pocket structure 152 has a long liquid passageway 154 which extends into a bottom corner of the dispenser for permitting all of the liquid in the container to be readily dispensed, and this is slightly different from that shown in FIG. 5. The air pocket structure 152 has a threaded outlet 154 which is a relatively large bore 156 and is short in length, and terminates in a wall 155 with an orifice 159 to provide dispensing of low viscosity liquids, in the same manner as shown in FIG. 8. The exterior 157 of the outlet is threaded to receive a cap 158 so that the dispenser can be transported. The air pocket structure also has a back wall 160 which is shaped to define an aperture 162 therein. The container 150 has a neck 164 which is threaded to receive a cap 166 which can be removed to permit filling of the container in a manner as previously described.

When the liquid is inserted in the container to a level 168 the viscosity of the liquid, ambient temperature and partial pressure in space above the level of the liquid 168 defines in part the level of an auxiliary body of liquid 170 in the air pocket structure ie the amount of product to be dispensed. However, the liquid 170 also rises to the top of the aperture 162 independently of the viscosity of the liquid. Thus the height between the top of the aperture 162 and the lower part of the outlet is $H_{tc}$ which is the temperature compensation amount of the dispenser. It will be appreciated that by locating the aperture 162 at various levels in the back wall varying amounts of temperature compensation can be designed to suit different liquids in different environmental conditions. Dispensing of the liquid is carried out in a similar manner to that described with reference to FIG. 10. When the container is tipped about 135°, and the resilient walls are squeezed, the liquid is dispensed from the outlet 154 and the remaining liquid does not enter opening 156 in the dispensing position. After the bottle is positioned upright, in response to a pressure decrease, air rushes in through the outlet 154 and slows down in the air pocket structure 152 to force any liquid residue in the outlet into the auxiliary body of liquid which again sits at the level defined by the top of aperture 162. The aperture 162 is made sufficiently small so that air rushing back in through orifice 159 does not rapidly pass through the aperture 162 to go through the liquid into the space above liquid level 168. Thus there is proper suck-back and effective cleaning of the outlet so that liquids having a wide range of viscosities and particularly low to medium viscosity liquids can be dispensed. It will appreciated that a significant advantage of this structure is control over the temperature compensation and amount of liquid which can be unit dose dispensed. This can be set for a predetermined temperature range when the dispenser is three quarters empty so that even a 30° or 40° change in temperature would not result in an advertent leakage of the liquid. It will also be appreciated that by locating th outlet 154 at the top of the air pocket structure and having a curved back wall 160 there is minimal amount of air which could possibly be trapped during the dispensing condition with the result that there is even, continuous pouring of the liquid and efficient suck-back and cleaning of the outlet when pressure is released.

Various modifications may be made to the structure of FIG. 12 without departing from the scope of the invention. For example, the liquid could be inserted in the same manner as shown in FIGS. 5 to 8 and the need for the cap and neck and dispensing bottle obviated. The bottle could also be moulded with integral bellows as shown in FIG. 1 so that depression of the bellows results in a pressure increase, when the bottle is tipped for providing unit dose dispensing. Also the orifice 159 could be made as large as the bore to facilitate dispensing of viscous liquids.

Reference is now made to FIG. 13 of the drawings which shows part of the body of a dispenser 180, similar to that shown in FIG. 12, to which is inserted an air pocket structure 182. The air pocket structure is very similar to that shown in FIG. 10, however the liquid passageway is defined by downwardly extending conduit 184 which is of a very narrow bore and extended almost to the base 186 of the container. This arrangement is designed to permit very controlled dispensing of very low viscosity liquids. With very low viscosity liquids there is a tendency in response to pressure for the liquid level to rise within the air pocket structure very rapidly and, because of the low back pressure, to be dispensed very quickly through the outlet 188. By providing a very narrow bore, liquid passageway 184 in response to pressure in the liquid, the liquid level rises into the air pocket structure relatively slowly so that dispensing from the outlet 188 is controlled. It will be appreciated that the outlet is threaded to receive a cap 190 to permit transport of the dispenser when filled.

The operation of dispensing and suck-back is similar to that described in previous embodiments and the outlet chamber is designed so that there is sufficient temperature compensation to compensate for a temperature increase of 30° to 40° with the dispenser almost empty without liquid inadvertently leaking from the outlet. The dispenser can also be filled in a manner as shown in FIGS. 7 and 8 so that the dispenser can either be disposable or refillable. Despite having a narrow liquid passageway means, this would not affect the suck-back because air rushing in would lose energy in the air pocket structure and effect efficient and rapid cleaning of the outlet even with high viscosity liquids to prevent dripping. Of course a small orifice at the exit of outlet 188 may be provided to provide further control of low viscosity liquids.

Reference is now made to FIG. 14 of the drawings which shows a jug type dispenser for dispensing large amounts of liquid for example liquid detergent and bleach. A container, generally indicated by reference numeral 200, has a bottom liquid passageway, generally indicated by reference numeral 202, and threaded shoulders 204 for receiving a bottom base cap 206. The base cap 206 and bottom wall 208 of the container define an air pocket 210. The dispenser has a handle 212 to permit the container to be carried and easily tipped, and a neck structure 214 through which the container can be filled and a cap 216 for sealing the neck. The liquid passageway 202 extends towards the base 220 of the base cap 206. The air pocket structure 214 extends substantially across the width of the container 200 so that almost all of the liquid will be dispensed.

In use, the liquid in the container has a level 222 above which is a volume of air at reduced pressure as described in previous embodiments. The liquid passageway 202 permits an auxiliary body of liquid, generally indicated by reference numeral 224, to exist in the air pocket structure 210. The auxiliary body of liquid has a liquid level 226 which is set by the viscosity of the liquid, ambient temperature and the position of the neck, as previously described. An air pocket outlet 228 is defined as an aperture in the wall of the base cap 206 and the outlet in this instance terminates in a dispensing exit 230 and at the same level thereof. It will be seen that the exit 230 is less than $\frac{1}{4}$ the height of the dispensing container. The liquid passageway 202 is spaced very close to the rear wall of the container so that unit doses of liquid can be dispensed as will be later described.

In an operative condition, liquid in the container rises to a level 226 and in order to dispense the handle 212 is grasped and the container is inverted throught 90° so that the auxiliary body of liquid and the air pocket structure 210 is dispensed through exit 230. As the container is inverted through 90° the liquid in interior 201 is moved such that there is no liquid in the vicinity of the passageway 202 and only the auxiliary body of liquid is dispensed. Thus the amount of liquid dispensed from the container is very accurate.

It will be appreciated that various modifications may be made to this embodiment without departing from the scope of the invention. For example if the liquid passageway 202 were moved nearer to the outlet 230, when the container was tilted all of the liquid would not automatically run into the container away from the air pocket structure and pouring would be continuous. In this situation a desired amount of liquid could be dispensed. Also although the container is shown as being made of two parts screwed together, this could be coupled in another manner such as snap-fitting as shown with reference to FIGS. 10 to 13. In addition the container could be made transparent so that the volume of liquid is readily observed. Furthermore the outlet could be provided with a flip top in the manner shown in FIG. 3 to seal the outlet and facilitate transport.

In addition, for the dispensers shown it will be understood that the means for increasing pressure could be an external source of air for example to facilitate automatic liquid dispensing. Also the container could be shaped with the air pocket structure projecting at the lower end of the container in which case, for complete emptying of the container, the liquid passageway would only extend across the width of the air pocket structure. Also the size of the outlet can be varied to permit dispensing liquids of different viscosities. The orifice may be small as shown in FIGS. 8 and 12 to facilitate controlled dispensing of low viscosity liquids and such small orifices can be applied to all embodiments shown. For higher viscosities the orifice is larger as shown in FIGS. 1, 3, 5, 7 and 10.

From the foregoing description of the embodiments it will be appreciated that there are provided liquid sidewall dispensers which have numerous technical and commercial advantages over existing dispensers. With these structures, dripping of the liquid even with viscous liquids is eliminated and temperature compensation is provided so that there is no leakage of the liquid even when the dispenser is nearly empty and a variation in temperature of 30° to 40° F. occurs. The proportions of the outlet and air pocket structure and location of the air pocket structure in a lower portion of the container ensures that there is minimal resistance to dispensing the liquid, even very viscous liquids, and there is suck back of liquid so that dripping is eliminated. The dispenser can also be mass produced using existing bottle filling techniques which is a significant commercial advantage over other dispensers. Furthermore, the dispenser and air pocket structure is designed so all of the liquid can be dispensed. Also the container could be made in one or two parts, the latter having an air pocket structure and a container and the dispensers can be made refillable or disposable depending on the whether or not the container is provided with a a cap. Furthermore the basic design can be modified in a variety of ways to control dispensing of very low viscosity liquids to provide consistent unit dose dispensing and to provide controlled temperature compensation independent of the viscosity of the liquids. Finally, the sidewall exit provides visual feedback to the user and results in controlled dispensing.

These embodiments should not be construed to limit the scope of the invention which is set forth in the appended claims.

I claim:

1. A sidewall dispenser for dispensing liquid from an upright position, said dispenser comprising:

(a) container means for receiving a supply of the liquid, said container means having a container base, a container top and at least one sidewall coupling said container base to said container top, defining a container interior;

(b) an air pocket means located within said container means at a portion adjacent the container base for containing an auxiliary body of the liquid, said air pocket means having a top portion, a bottom portion, a back wall portion spaced from said at least one sidewall, and a front portion, said back wall portion, said top portion and said front wall portion defining an air pocket portion within said air pocket means for retaining a pocket of air above said auxiliary body of said liquid;

(c) liquid passageway means connecting the air pocket portion and the interior of said container means said liquid passageway means being located at said bottom portion of said air pocket means;

(d) outlet means providing an exit from said air pocket means through a lower portion of said at least one sidewall, said outlet means being coupled to said air pocket means and being at a level above said liquid passageway means, said outlet means terminating in a liquid dispensing exit, said liquid dispensing exit being at substantially the same level as said outlet means;

(e) pressure increasing means operable for providing a pressure increase within said container means for causing liquid to be forced out of said dispensing exit; and (f) liquid suck-back control means for sucking back liquid residue remaining in said outlet means and being proportioned with a cross-section sufficient to permit liquid to be forced through the outlet means and to cause an inrush of air as a result of operation of the liquid suck-back control means to positively drive liquid residue into said air pocket means to eliminate dripping from said outlet means.

2. A sidewall dispenser as claimed in claim 1 wherein said liquid passageway means extends substantially across the width of the interior of said container means at a location in proximity to said container base.

3. A sidewall dispenser as claimed in claim 2 wherein said dispensing exit has means for receiving a closure to permit said exit to be opened and closed.

4. A sidewall dispenser as claimed in claim 1 wherein said dispensing exit has means for receiving a closure to permit said exit to be opened and closed.

5. A sidewall dispenser as claimed in claim 1 wherein said pressure increasing means is provided by said at least one sidewall being resilient, said resilient sidewall being responsive to a hand force to deform to provide said pressure increase within said container means for causing liquid to be forced out of said dispensing exit and upon release of said hand force applied to said sidewall, said resilient sidewall returns to an undeformed shape, actuating said liquid suck-back control means for sucking-back liquid residue remaining in said outlet means into said air pocket means.

6. A sidewall dispenser as claimed in claim 1 wherein said liquid pressure increasing means is provided by resilient bellows means located at the top of said container means and being integral with said at least one side wall, said resilient bellows means being depressable by a hand force to create a pressure increase within said container means for causing liquid to be forced out of said dispensing exit and after removal of said hand force said resilient bellows means returns to its original position and actuates said liquid suck-back means for sucking back liquid residue remaining in said outlet means into said air pocket means.

7. A sidewall dispenser as claimed in claim 1 including outlet closure means associated with said outlet means, said outlet closure means being moveable between a first and a second position, wherein in said first position said closure means permits communication between said air pocket portion and the exterior of said container and in said second position said outlet closure means seals said container from said external atmosphere.

8. A sidewall dispenser as claimed in claim 4 including closure means associated with said outlet means, said outlet closure means being moveable between a first and a second position, wherein in said first position said closure means permitting communication between said air pocket portion and the exterior of said container and in said second position said outlet closure sealing said container from said external atmosphere.

9. A sidewall dispenser as claimed in claim 1 wherein said container top has a neck through which liquid can be supplied into said container interior, and said neck having an associated cap for sealing said opening.

10. a sidewall dispenser as claimed in claim 1 wherein said dispensing exit is located in said at least one side wall at or less than one third of the height of said sidewall.

11. A sidewall dispenser for dispensing liquid products from a non-inverted position, said liquid dispenser comprising:

(a) container means for receiving a supply of liquid, said container means having a container base, a container top and at least one sidewall coupling said container base to said container top, to define a container interior;

(b) an air pocket means located within said container means at a portion adjacent the container base for containing an auxiliary body of the liquid, said air pocket means having a top portion, a bottom portion, a back wall portion spaced from said at least one sidewall, and a front wall portion, said back wall portion, said top portion and said front wall portion defining an air pocket portion within said air pocket means for retaining a pocket of air above said auxiliary body of said liquid;

(c) liquid passageway means connecting the air pocket portion and the interior of said container means said liquid passageway means being located at said bottom portion of said air pocket means;

(d) outlet means providing an exit from said air pocket means through a lower portion of said at least one sidewall, said outlet means being coupled to said air pocket means and being at a level above said liquid passageway means, said outlet means terminating in a liquid dispensing exit, said liquid dispensing exit being at substantially the same level as said outlet means;

(e) pressure increasing means operable for providing a pressure increase within said container means for causing liquid to be forced out of said dispensing exit; and (f) liquid suck-back control means for sucking back liquid residue remaining in said outlet means and being proportioned with a cross-section sufficient to permit liquid to be forced through the outlet means and to cause an inrush of air as a result of operation of the liquid suck-back control means to positively drive liquid residue into said air pocket means to eliminate dripping from said outlet means, the dispenser having, in an operative condition, a supply of liquid in said hollow container body, said supply of liquid having a liquid supply level spaced from said container top and said supply level and said container top defining a partial vacuum above said liquid supply level, said liquid passageway means providing liquid communication between the lower portion of said liquid in said container means and the air pocket portion, and liquid being present in said air pocket structure to provide said auxiliary body of liquid, said auxiliary body of liquid having an auxiliary liquid level, above which is said air pocket portion at atmospheric pressure, the auxiliary liquid level being controlled by the existence of said partial vacuum, by the viscosity of said liquid, and by the ambient temperature, the liquid sidewall dispenser having an amount of temperature compensation defined by the height between the auxiliary liquid level and the dispensing exit, and the air pocket structure being proportioned so that said temperature compensation is effective over a predetermined temperature range when said dispenser is almost empty, the arrangement being such that in operation, actuation of the pressure increasing means forces liquid out through said air pocket structure and said dispensing exit which is proportioned to provide suck-back sufficient to prevent dripping of said liquid following release of pressure and actuation of said liquid suck-back control means, the energy of air replacing the dispensing liquid decreasing after it passes through said dispensing exit to cause said liquid in said outlet means to flow into said auxiliary body of liquid, the distance between said dispensing exit and said liquid passageway means being selected for the viscosity of liquid so as to cause air being sucked-back to force liquid from the outlet into the auxiliary body of liquid.

12. A sidewall dispenser for dispensing liquid products from a non-inverted position, said sidewall dispenser comprising:

container means for receiving a supply of the liquid, said container means having a container base, a container top and at least one sidewall coupling said container base to said container top to define a container interior;

an air pocket means located within said container means at a portion adjacent the container base for containing an auxiliary body of the liquid, said air pocket means having a top portion, a bottom portion, a back wall portion spaced from said at least one sidewall, and a front wall portion, said back wall portion, said top portion and said front wall portion defining an air pocket portion within said air pocket means for retaining a pocket of air above said auxiliary body of said liquid;

liquid passageway means connecting the air pocket portion and the interior of said container means said liquid passageway means being located at said bottom portion of said air pocket means and said liquid passageway means extending substantially across the width of the interior of said container means;

outlet means providing an exit from said air pocket means through a lower portion of said at least one sidewall, said outlet means being coupled to said air pocket means and being at a level above said liquid passageway means, said outlet means terminating in a liquid dispensing exit, said liquid dispensing exit being at substantially the same level as said outlet means and said dispensing exit having means for receiving a closure;

pressure increasing means operable for providing a pressure increase within said container means for causing liquid to be forced out of said dispensing exit; and liquid suck-back control means for sucking back liquid residue remaining in said outlet means being and proportioned with a cross-section sufficient to permit liquid to be forced through the outlet means and to cause an inrush of air as a result of operation of the liquid suck-back control means to positively drive liquid residue into said air pocket means to eliminate dripping from said outlet means.

13. A liquid dispenser as claimed in claim 12 wherein said pressure increasing means is provided by said at least one sidewall being resilient, said resilient sidewall being responsive to a hand force to deform to provide said pressure increase within said container means for causing liquid to be forced out of said dispensing exit and upon release of said hand force applied to said sidewall, said resilient sidewall returns to an underformed shape, actuating said liquid suck-back control means for sucking-back liquid residue remaining in said outlet means into said air pocket means.

14. A liquid dispenser as claimed in claim 12 wherein said liquid pressure increasing means is provided by resilient bellows means locatd at the top of said container means and being integral with said at least one side wall, said resilient bellows means being depressable by a hand force to create a pressure increase within said container means for causing liquid to be forced out of said dispensing exit and after removal of said hand force said resilient bellows means returns to its original position and actuates said liquid suck-back means for sucking back liquid residue remaining in said outlet means into said air pocket means.

15. A sidewall dispenser as claimed in claim 12 wherein said dispensing exit is located in said at least one side wall at or less than one third of the height of said sidewall.

16. A sidewall dispenser for dispensing liquid products from a non-inverted position, said dispenser liquid comprising:

container means for receiving a supply of the liquid, said container means having a container base, a container top and at least one sidewall coupling said container base to said container top, defining a container interior;

an air pocket means located within said container means at a portion adjacent the container base for containing an auxiliary body of the liquid, said air pocket means having a top portion, a bottom portion, a back wall portion spaced from said at least one sidewall, and a front wall portion, said back wall portion, said top portion and said front wall portion defining an air pocket portion within said air pocket means for retaining a pocket of air above said auxiliary body of said liquid;

liquid passageway means connecting the air pocket portion and the interior of said container means said liquid passageway means being located at said bottom portion of said air pocket means;

outlet means providing an exit from said air pocket means-through a lower portion of said at least one sidewall, said outlet means being coupled to said air pocket means and being at a level above said liquid passageway means, said outlet means terminating in a liquid dispensing exit coupled thereto, said liquid dispensing exit being at substantially the same level as said outlet means and said dispensing exit having means for receiving a closure;

pressure increasing means operable for providing a pressure increase within said container means for causing liquid to be forced out of said dispensing exit; and liquid suck-back control means for sucking back liquid residue remaining in said outlet means and being proportioned with a cross-section sufficient to permit liquid to be forced through the outlet means and to cause an inrush of air as a result of operation of the liquid suck-back control means to positively drive liquid residue into said air pocket means to eliminate dripping from said outlet means, the dispenser having, in an operative condition, a supply of liquid in said hollow container body, said supply of liquid having a liquid supply level spaced from said container top and said supply level and said container top defining a partial vacuum above said liquid supply level, said liquid passageway means providing liquid communication between the lower portion of said liquid in said container means and the air pocket portion, and liquid being present in said air pocket structure to provide said auxiliary body of liquid, said auxiliary body of liquid having an auxiliary liquid level, above which is said air pocket portion at atmospheric pressure, the auxiliary liquid level being controlled by the existance of said partial vacuum by the viscosity of said liquid and by the ambient temperature, said liquid sidewall dispenser having an amount of temperature compensation defined by the height between the liquid level and the dispensing exit, and the air pocket structure being proportioned so that said temperature compensation is effective over a predetermined temperature range when said dispenser is almost empty, the arrangement being such that in operation, a pressure increase within the container body forces liquid out through said dispensing exit and said air pocket structure and said dispensing exit also being proportioned to provide suck-back sufficient to prevent dripping of said liquid following release of pressure, the energy of air replacing the dispensing liquid decreasing after it passes through said dispensing exit to cause said liquid in said outlet means to flow into said auxiliary body of liquid, the distance between said dispensing exit and said liquid passageway means being selected for the viscosity of liquid so as to cause air being sucked-back to force liquid from the outlet into the auxiliary body of liquid.

17. A sidewall dispenser for dispensing liquid products, said dispenser liquid comprising:

container means for receiving a supply of liquid, said container means having a container base, a container top and at least one sidewall coupling said container base to said container top to define a container interior;

an air pocket means located within said container means at a portion adjacent the container base for containing an auxiliary body of the liquid, said air pocket means having a top portion, a bottom portion, a back wall portion spaced from said at least one sidewall, and a front wall portion, said back wall portion, said top portion and said front wall portion defining an air pocket portion within said air pocket means for retaining a pocket of air above said auxiliary body of said liquid;

liquid passageway means connecting the air pocket portion and the interior of said container means said liquid pasageway means being located at said bottom portion of said air pocket means;

outlet means providing an exit from said air pocket means through a lower portion of said at least one sidewall, said outlet means being coupled to said air pocket means and being at a level above said liquid passageway means, said outlet means terminating in a liquid dispensing exit, said liquid dispensing exit being at substantially the same level as said outlet means.

18. A dispenser for dispensing liquids from the side of the dispenser in response to hand forces applied to the dispenser in an upright position, the dispenser comprising:

a container having a base and a resilient upright wall;

outlet control means attached to the resilient upright wall and positioned to receive liquid from the container immediately adjacent the bottom of the container, the outlet control means including an outlet through which liquid issues from the dispenser and air pocket means extending vertically downwards from the outlet with the dispenser in its upright position;

the upright resilient wall being deformable by said hand force to increase the pressure in the container to cause flow of liquid from the container, through the air pocket means and out of the dispenser via the outlet, the resilient wall providing pressure restoring means which, after deformation of the resilient wall to increase pressure to dispense liquid, the resilient wall returns to its original shape thereby causing pressure equalisation in the air pocket means by drawing air into the dispenser through the outlet; and said outlet being proportioned with a cross-section sufficient to permit liquid to be forced outwardly through the outlet and to permit an inrush of air as a result of the return of the resilient wall to its original shape to positively drive droplets of liquid back from the outlet into the air pocket means to thereby eliminate the risk of dripping from the outlet.

19. A dispenser for dispensing liquids from the side of the dispenser in response to hand forces applied to the dispenser in an upright position, the dispenser comprising:

a container having a base and an upright wall, a bellows means being coupled to said upright wall;

outlet control means attached to the upright wall and positioned to receive liquid from the container immediately adjacent the bottom of the container, the outlet control means including an outlet through which liquid issues from the dispenser and air pocket means extending vertically downwards from the outlet with the dispenser in its upright position;

the bellows means being depressable by said hand force to increase the pressure in the container to cause flow of liquid from the container, through the air pocket means and out of the dispenser through the outlet, the bellows being resilient to return to the original shape after release of said hand force so that after depression of the bellows to dispense liquid, the return of the bellows to the original shape causes pressure equalisation in the air pocket means by drawing air into the dispenser through the outlet;

said outlet being proportioned with a cross-section sufficient to permit liquid to be forced through the outlet and to permit an inrush of air as a result of the operation of the bellows returning to its original underformed shape to positively drive droplets of liquid back from the outlet into the air pocket means to thereby eliminate the risk of dripping from the outlet.

* * * * *

UNITED STATES PATENT AND TRADEMARK OFFICE

CERTIFICATE OF CORRECTION

PATENT NO. : 4,645,097

DATED : February 24, 1987

INVENTOR(S) : John G. Kaufman

It is certified that error appears in the above-identified patent and that said Letters Patent are hereby corrected as shown below:

Claim 8, line 1, in place of "4" insert --1--.

Signed and Sealed this

Sixteenth Day of February, 1988

*Attest:*

*Attesting Officer*

DONALD J. QUIGG

*Commissioner of Patents and Trademarks*